US009129508B2

(12) United States Patent
Kuntzel

(10) Patent No.: US 9,129,508 B2
(45) Date of Patent: Sep. 8, 2015

(54) METHOD FOR WAKENING UP A DRIVER OF A MOTOR VEHICLE

(75) Inventor: Klas Kuntzel, Djursholm (SE)

(73) Assignee: SVENSKA UTVECKLINGS ENTREPRENOREN SUSEN AB, Djursholm (SE)

( * ) Notice: Subject to any disclaimer, the term of this patent is extended or adjusted under 35 U.S.C. 154(b) by 841 days.

(21) Appl. No.: 13/392,165

(22) PCT Filed: Aug. 16, 2010

(86) PCT No.: PCT/SE2010/050888

§ 371 (c)(1), (2), (4) Date: Feb. 24, 2012

(87) PCT Pub. No.: WO2011/025437

PCT Pub. Date: Mar. 3, 2011

(65) Prior Publication Data

US 2012/0154156 A1 Jun. 21, 2012

(30) Foreign Application Priority Data

Aug. 26, 2009 (SE) ..... 0901120
Aug. 13, 2010 (SE) ..... 1050852

(51) Int. Cl.
*G08B 23/00* (2006.01)
*G08B 21/06* (2006.01)

(52) U.S. Cl.
CPC ..... *G08B 21/06* (2013.01)

(58) Field of Classification Search
CPC ..... B60W 40/08; B60W 2040/0872; G08B 25/016; G08B 21/06
See application file for complete search history.

(56) References Cited

U.S. PATENT DOCUMENTS

| | | | | |
|---|---|---|---|---|
| 6,107,939 | A * | 8/2000 | Sorden | 340/901 |
| 6,717,518 | B1 * | 4/2004 | Pirim et al. | 340/576 |
| 2002/0105438 | A1 * | 8/2002 | Forbes et al. | 340/901 |
| 2007/0080793 | A1 * | 4/2007 | Blase | 340/435 |
| 2008/0258884 | A1 | 10/2008 | Schmitz | |
| 2009/0066521 | A1 * | 3/2009 | Atlas et al. | 340/575 |
| 2009/0132109 | A1 * | 5/2009 | Galley et al. | 701/29 |

FOREIGN PATENT DOCUMENTS

| | | |
|---|---|---|
| DE | 10238324 A1 | 4/2004 |
| WO | 2005023588 | 3/2005 |
| WO | 2008044119 | 4/2008 |
| WO | 2008090451 | 7/2008 |
| WO | 2009005444 | 1/2009 |

OTHER PUBLICATIONS

International Search Report dated Dec. 17, 2010, corresponding to PCT/SE2010/050888.

K.Kozak, et al.; "Evaluation of lane departure warnings for drowsy drivers"; Proceedings of the Human Factors and Ergonomics Society 50th Annual Meeting, s 2400-2404, 2006.

* cited by examiner

*Primary Examiner* — Kerri McNally
*Assistant Examiner* — Renee Dorsey
(74) *Attorney, Agent, or Firm* — Young & Thompson

(57) ABSTRACT

Disclosed is a method and system to avoid traffic accident by waking up, without false alarm, a sleeping or completely inactive motor vehicle driver. The method and the system utilizes simultaneously at least four different specified detections with so arranged thresholds for wake-up alarm, that the driver after waking up without false alarm has the possibility to avoid an impending traffic accident by evasive maneuver and other vehicle control.

12 Claims, 3 Drawing Sheets

METHOD FOR WAKENING UP A DRIVER OF A MOTOR VEHICLE

BACKGROUND OF THE INVENTION

1. Field of the Invention

The present invention relates to a method to wake up a sleeping motor vehicle driver.

The present invention is included in the concept of active safety systems for motor vehicles. More specifically the invention provides a quick and safe way to prevent, without false alarm, traffic accidents, which are caused by the driver having fallen asleep at the wheel or behaves like a sleeping driver.

2. Description of the Related Art

Much research has been devoted to examine drowsiness of motor vehicle drivers and to develop suitable detection ways and alarm arrangements in order to warn the driver of the increasing risks, which are combined with driver fatigue.

In spite of such research, no method or system has been produced, by means of which it is possible to predict, with wanted accuracy, at which coming point in time the driver would fall asleep. It is known that falling asleep occurs abruptly, but the exact point in time cannot be predicted due to variations between different individuals and variations for one and the same individual at different moments.

Accessible or otherwise described systems in this area may include different types of warnings, when drowsiness has been verified through camera studies of the driver's eyes or by assembling different parameters and executing certain calculations. Warnings may be shown optically on instruments, be given acoustically with buzzer or with recorded voice warnings or be made haptically with vibrations, for instance in the safety belt, in the driver's seat or in the steering wheel.

The driver's behavior and activity degree constitutes another known basis for evaluating if a dangerous traffic situation is developing. It is for instance well-known to let inactivity at the steering wheel constitute a sign, that the driver may be falling asleep, as in U.S. Pat. No. 7,019,653 B2, in which it is recommended an acoustic alarm at a point in time, when no steering wheel movements have occurred during a certain time period, as a sign of the fact that the driver has fallen asleep. This method, however correct, may involve two different drawbacks, namely (a) that an accident may very well occur prior to the alarm, or (b) that a false alarm occurs, if the driver is still awake.

Another group of alarm systems emanates from the vehicle's departure from its intended lateral position in the driving lane, which might be due to the driver falling asleep. Several different systems of this kind are known. As detecting means, utilized to assess the lateral position of the vehicle is chiefly noticed camera based systems, which track the lane markings and calculate the vehicle's lateral position in real time. If the system predicts or establishes that the vehicle crosses the lane marking a warning may be issued to the driver. Other detecting means may involve laser systems, colour camera technique and graphical data processing to determine the road limits. Still other detecting means have been described, such as the use of GPS for determining position combined with digital road maps and similar, combined or not with more advanced camera systems and picture analysis techniques.

US patent no. 2007/0024430 A1 describes a method which not only takes into account the lateral position of the vehicle, but also the driver's activity level, which may include the driver being asleep. The object of the described invention is to be able to distinguish between intended and unintended lane departures in order to avoid false alarm, when an intended lane crossing occurs.

The description in WO 2007/136338 A1 refers to a method to alarm a vehicle driver, which method is expected to be particularly effective by simultaneously triggering the two existing types of vibration sensitive sensors in the human skin.

A successful existing method to decrease traffic accidents in situations, when a driver's steering of the vehicle fails, which may be caused by drowsiness or falling asleep at the steering wheel, are rumble strips in the sides of the lane or the roadway, which generate a vibration and sound when the vehicle's tires during the ride reach the rumble strips. Side rumble strips are, however, not everywhere, which underlines the need of a vehicle-based safety system. The same is true for dividing fences between opposite lanes, which also successfully may reduce traffic accidents.

BRIEF SUMMARY OF THE INVENTION

The present invention describes a method and a system, which prevent false alarm, but still result in a quick and efficient alarm for an inactive driver.

The present invention thus refers to a method to wake up a motor vehicle driver having fallen asleep with a wake-up alarm, the triggering of which is controlled by threshold values for from at least two different detection systems, of which a first detection system is brought to detect driver inactivity and at least another detection system is brought to detect the vehicle's movement relative to the actual lane and/or to objects near the vehicle, and is characterized in that for an alarm to be brought to be raised one of two requirements shall be met, where a first requirement is that a predetermined first lower threshold value for driver inactivity is crossed as well as that a predetermined threshold value for the vehicle's movement is crossed and where a second requirement is that only a predetermined higher threshold value for driver inactivity is crossed.

The invention entails a method to prevent traffic accidents by waking up motor vehicle drivers, who have fallen asleep or otherwise are completely inactive at the steering wheel, and where the wake-up alarm is given on the basis of several different types of alarm thresholds, that is different threshold values to trigger alarm. These alarm thresholds are chosen to wake up the driver, without false alarm, in time to prevent an impending accident. The invention utilizes preferably in known way a haptic alarm in the steering wheel, suited in a safe way to wake up a sleeping driver, whose hands are still resting on the steering wheel. By using several different types of alarm thresholds, the cited drawbacks of false alarm versus accident risks are reduced.

The driver's inactivity can be detected or registered in different ways with known technique to form a data set, from which an alarm threshold value can be set. For instance may, as in WO 136338 A1, either of two easily assembled values be chosen, one being the time elapsed from the last detected steering wheel movement, and the other being the vehicle's traveled distance on the road since the last steering movement.

Within the frame of considering different threshold values and traffic accident risks the inventor has analyzed various tests, which have been carried out with passenger cars. The first group of tests has had the aim of mapping activity versus inactivity at the steering wheel. The second group of tests has had the aim of mapping vehicle movements during driver inactivity at the steering wheel under different road conditions.

Among the conclusions from the first group of tests the inventor found that most small corrective steering wheel movements occurred within 2 seconds after the previous steering wheel movement and that intervals between the driver's steering wheel movements seldom exceeded 4 seconds.

Theoretically, the larger masses of big commercial vehicles in comparison with those of passenger cars may have influence on the frequency of normal corrective steering wheel movements, with slightly longer intervals between consecutive steering wheel movements.

Among the conclusions from the second group of tests the inventor further found that the vehicle's trajectory from the starting point of driver inactivity varied strongly with the road conditions. The time from the driver having started to be inactive at the steering wheel to the moment, when the vehicle's front wheels had reached one of the lane's sidelines varied from just over one second to over 30 seconds, with an arithmetic average between 5 and 6 seconds. Theoretically larger, heavier vehicles would for earlier stated reason be expected to show slower travel direction change and longer times than stated above.

The alarm threshold values utilized in a method according to the invention, are chosen on two governing principles (a) to wake up the driver in time for the driver to be able to perform an evasive maneuver in order to avoid an impending traffic accident and (b) to avoid as far as possible false wake-up alarms. Determining of threshold values may be made after further tests, including tests of waking up drivers and of the reaction time of drivers, who have just been awoken.

One utilized threshold value may be considered absolute by constituting an upper limit in time or traveled distance under complete driver inactivity and over which value the driver with certainty has fallen asleep. If this value would be set at 10 seconds in passenger cars and correspondingly higher in commercial vehicles, false alarm, i.e. wake up alarm to awake drivers, would occur very seldom indeed.

According to a preferred embodiment of the invention the mentioned detection system for the mentioned vehicle's movement includes at least a second detection system, which is brought to detect the vehicle's lateral departure from present lane, a third detection system which is brought to detect the relative speed and the distance to an object in the vehicle's travelling direction and a fourth detection system, which is brought to detect the relative speed and the distance to objects, which are present perpendicularly to the vehicle's travelling direction. Further, the wake-up alarm is brought to be raised, when the first detection system exceeds its mentioned predetermined lower threshold value for driver inactivity as well as at least one of the third or fourth detection system exceeds a predetermined threshold value for respective detection system.

According to a further preferred embodiment of the invention alarm inhibition is brought to occur when the first detection system has not exceeded the mentioned higher threshold value, as long as none of the above said second, third or fourth detection systems has reached its respective threshold value.

A second threshold value for wake-up alarm to an inactive driver might be set at a critical vehicle position and/or vehicle lateral speed in relation to the center line of the lane as a measure of traffic accident risk. Such a position can laterally correspond to a distance from the center line, which corresponds to the position when the vehicle's tires normally would hit the side rumble strips of the road. The lateral speed is at the same time a measure of the important time element, which determines how soon the vehicle reaches a critical lateral position related to the road geometry.

A third threshold for wake-up alarm to an inactive driver may be utilized and set at a critical vehicle position or vehicle speed in the travelling direction, which is sensed in a front collision warning system using radar technique or similar known technique and where the driver's activity is necessitated in order to prevent a traffic accident.

According to a preferred embodiment the mentioned lower threshold value is less than 2 seconds and the mentioned higher threshold value is over 4 seconds.

It is according to one embodiment preferred that the alarm is brought to be generated by a device, arranged to imitate sound and/or vibrations, which are created by the vehicle's passage over road rumble strips and with enough amplitude to wake the driver.

Another preferred embodiment is that the alarm is brought to be generated by a device, which generates vibrations in the vehicle's steering wheel.

A fourth threshold value for wake-up alarm to an inactive driver can be utilized and set based on indicated traffic accident dangers and obstacles on any side of the vehicle, which can arise by overtaking another vehicle, when the vehicle itself is overtaken or drives on a multi-lane motor way with traffic in neighbouring lane or at other traffic obstacles near the lane's outer border lines. The accident danger is exceptional if the driver would be asleep in situations described above and a sharp wake-up alarm, which alarms the driver within a second, is a critical necessity. Tests have shown, that falling asleep can occur at any time, even if the driver is engaged in overtaking another vehicle and really ought to be very alert.

The mentioned second, third and fourth threshold values can be controlled by an algorithm, which can include calculated time until a collision with an outside obstacle minus chosen times for waking up and for evasive maneuver and chosen safety margin.

According to the present method the driver's steering wheel movements shall be distinguishable from other smaller steering wheel movements, which may be caused by vehicle vibrations, mostly produced by forces between the vehicle's tires and the road surface. Tests with modern passenger cars have shown that non-driver initiated steering wheel movements have a limited amplitude. Steering wheel movements with larger amplitude may with certainty be regarded as caused by the driver. Suitable and known sensors and data processing technique can be chosen so that, for each vehicle type, one can differentiate between driver steering wheel movements and other possible steering wheel movements.

There may be situations, when the driver is not awoken by the steering wheel vibrations described above. If a driver, instead of having the hands on the steering wheel, would rest with underarms or elbow on the steering wheel, the vibrations might perhaps not be felt in the same way. In such a case a loud acoustical warning may also be included as alarm.

BRIEF DESCRIPTION OF THE DRAWINGS

The invention is described exemplifying below, partly in conjunction with FIGS. 1-3, which schematically illustrate embodiments in the form of block diagrams of a multithreshold value alarm system for avoiding traffic accidents according to the invention.

The alarm system with several different alarm thresholds according to the invention is shown schematically in FIGS. 1, 2 and 3 to illustrate embodiments, which are described in the following.

DETAILED DESCRIPTION OF THE PREFERRED EMBODIMENTS

Figure 1:
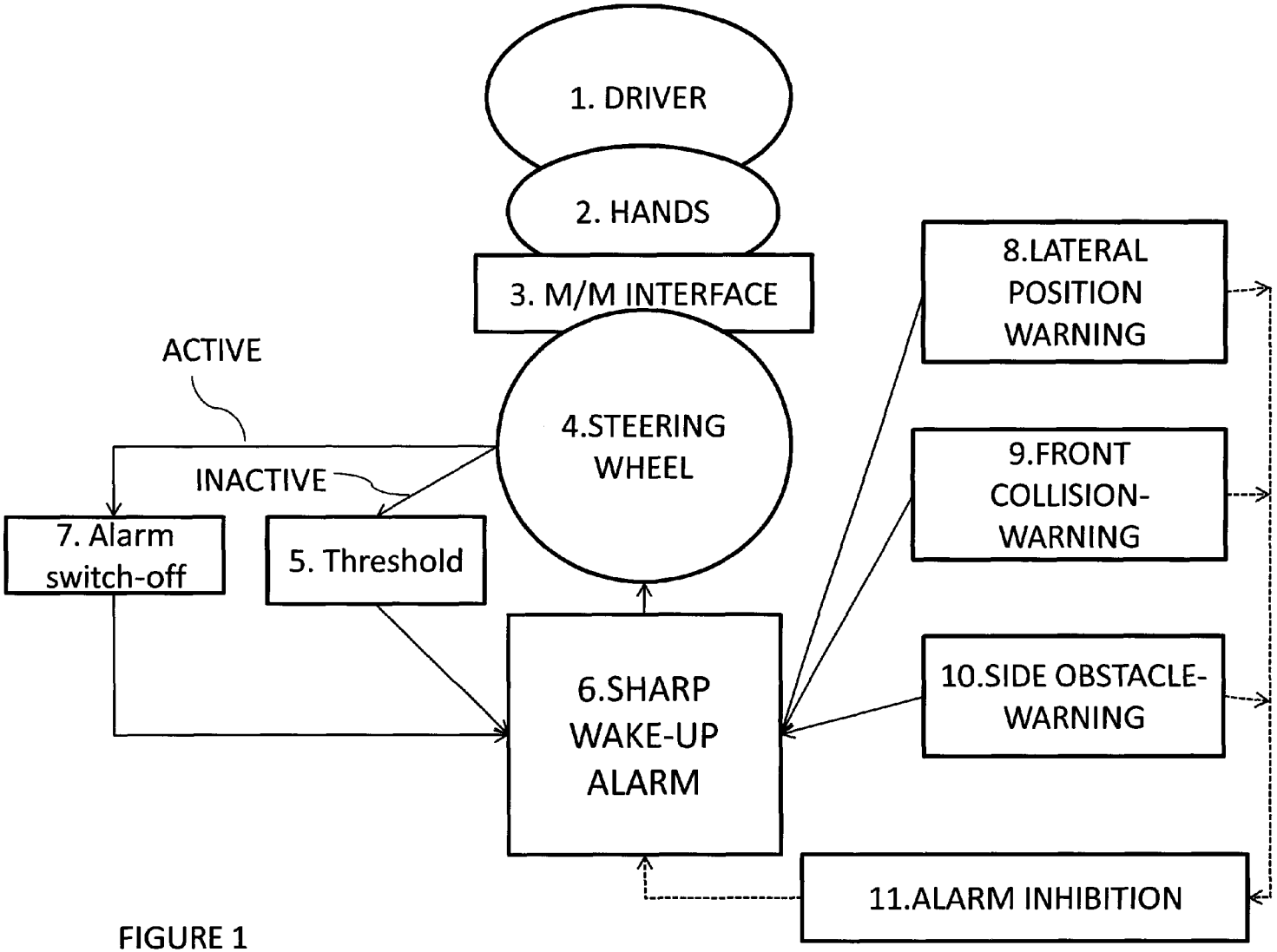

In FIG. 1, which shows a functional outline of the method and the system according to the invention, steering wheel inactivity data ($\alpha'=0$) are compared in a known way with a time threshold value 5 for steering wheel inactivity. Steering wheel activity means that the steering wheel is turned. If this threshold value 5 is exceeded a sharp wake-alarm 6 is initiated to wake up the driver 1 by means of a mechanical vibration V generated in the steering wheel 4 in the form of a sharp wake-up alarm 6, which is an already known and described alarm technique.

Three types of traffic accident dangers are represented by three detection systems, namely a warning system 8 for the vehicle's lateral position, a frontal obstacle warning system 9 and a side obstacle warning system 10, of which each is combined with its special alarm threshold, which has been chosen to indicate a traffic accident danger. Depending on the chosen embodiment of the invention these three threshold values may be utilized either to initiate or to inhibit 11 the sharp wake-up alarm, which is closer explained in connection with FIGS. 2 and 3.

Figure 3:
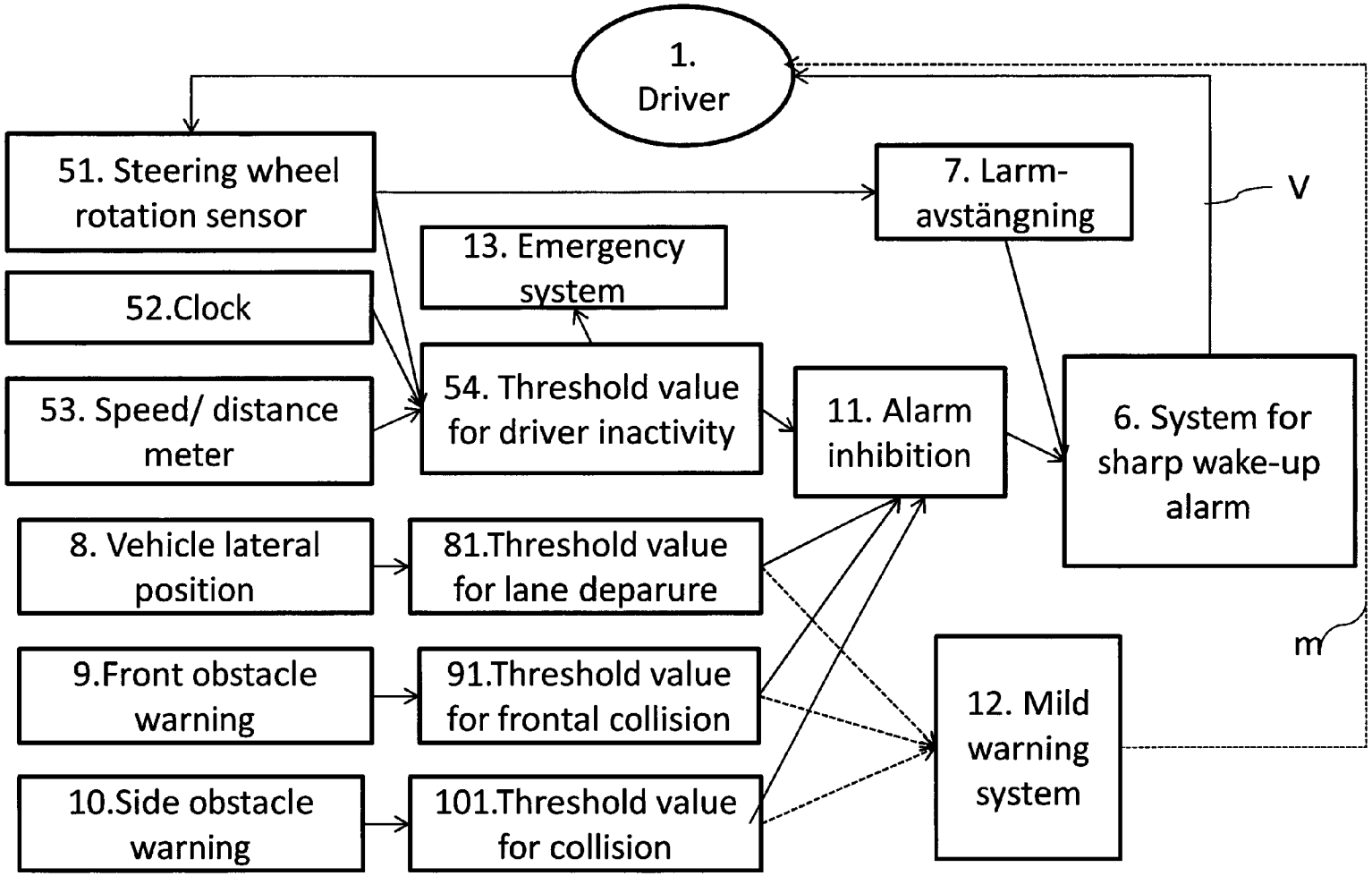

In FIG. 1 the alarm inhibition shown and the dashed lines refer to the embodiment, which is explained in connection with FIG. 3.

Due to the human-machine interface 3 between the driver's 1 hands 2 and the steering wheel 4 the vibrations V will cause the driver 1 in both embodiments to take immediate control and the ensuing movements $\alpha'\neq 0$, where $\alpha$ is the steering wheel's 4 turning angle, of the steering wheel 4 will initiate in a known way an automatic switch-off 7 of the wake-up alarm 6.

Figure 2:
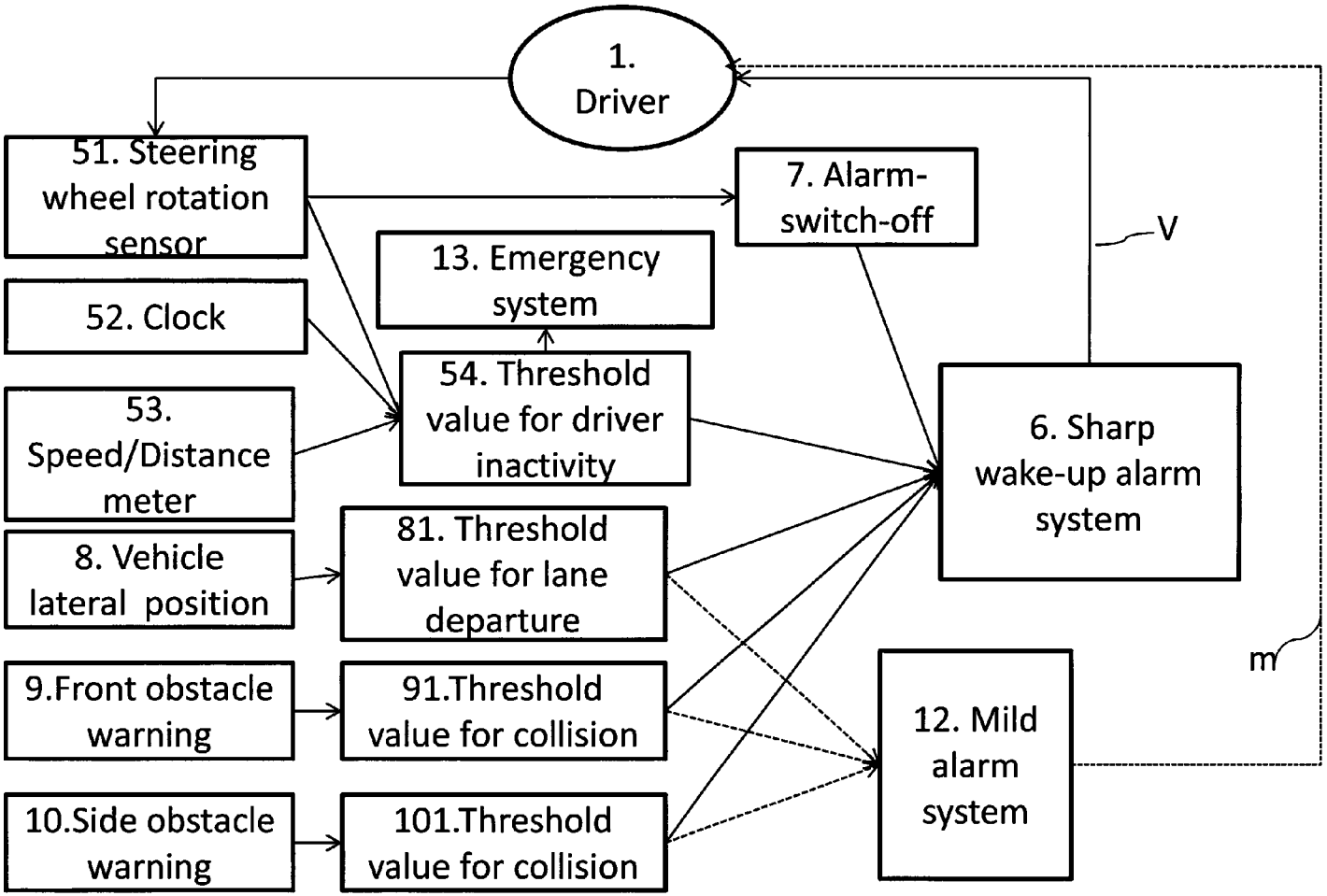

In FIG. 2 the three detection systems' 8, 9, 10 threshold alarms work in parallel, so that each of them can initiate a sharp wake-up alarm 6, when respective alarm threshold has been reached, provided that the steering wheel inactivity, $\alpha'=0$, has lasted at least 1 second. In this case the threshold value for wake-up alarm due to inactivity at the steering wheel, $\alpha'=0$, can be set at say 5 seconds and if none of the other three warning systems 8, 9, 10 have reached their threshold values for alarm, the higher threshold value for steering wheel inactivity 54 will initiate the wake-up alarm 6 to send the wake-up vibration V to the driver.

The threshold value for driver inactivity 54 can in a known way be a time threshold value, which is derived from inactivity signals, $\alpha'=0$, from a steering wheel angle sensor 51 and from a digital clock 52 or a threshold value in road distance, which is derived from the steering wheel angle sensor 51, from the digital clock 52 and from vehicle speed data or traveled road distance data 53, which are available in the vehicle's data system.

The threshold value for steering wheel inactivity 5 can be set first at a lower value, say 1 second, but its alarm initiation is inhibited by an alarm inhibition function 11 as long as none of the three other detection systems 8, 9, 10 has reached its respective threshold value. The threshold value for steering wheel inactivity 5 includes also a second and higher value, say 5-10 seconds, at which it closes the inhibition function, and initiates the vibration signal V of the wake-up alarm 6.

The threshold values of the three detection systems 8, 9, 10, which are utilized in conjunction with the present invention are the free choices of the system designer with the goal to give the driver a good chance of avoiding the accident. The role of the invention is to wake up the driver as quickly as possible and each alarm threshold value must be set accordingly, so that the driver can steer the vehicle from the dangerous position and use other driver functions, such as brake and gas pedal. Time values in connection with alarm thresholds, which have been mentioned above shall be regarded as examples and not to limit the invention to these or other numerical values.

The prime purpose of the wake-up alarm 6 is to prevent serious traffic accidents from occurring. But the alarm 6 also makes the driver aware of a very serious personal fatigue condition and unfitness to drive on without a sleeping pause, which the driver probably not ignores.

The detection systems for the vehicle's lateral position 8, for frontal collision risk 9 and side collision risk 10 may be based on different suitable known sensor systems, such as infrared camera, radar technique, color camera system, picture processing, GPS, ultrasound and other known means to measure distance, relative speed, position and other parameters.

The said systems 8, 9, 10 may also in a known way include lower alarm threshold values with the function to warn the driver 1 before a wake-up alarm 6 is initiated. As shown in FIG. 2 and FIG. 3 such a lower threshold value may initiate a mild alarm signal (m) of visual, acoustic or haptic character to the driver from a milder alarm warning system 12.

An active driver, who is being alerted by a mild warning alarm (m) may be expected to take necessary actions to eliminate the situation, which caused the alarm. Such actions may be to activate the travelling direction indicator, which ought to be used when changing lanes, or to bring back the vehicle into a better lane position by corrective steering or to brake the vehicle to avoid an indicated danger. A sleeping/inactive driver may not take notice of the mild alarm (m) and thereafter sharp wake-up alarm (V) will consequently follow, if the higher alarm threshold is reached.

Preferred embodiments of the present invention may utilize all known technique and all efficient methods to generate mechanical vibrations (V) in the steering wheel with suitable amplitudes, frequencies and durations, which are able to quickly awake a driver 1 with his hands resting on the steering wheel 4.

Should the driver 1 not have the hands resting on the steering wheel 4 the sharp wake-up alarm system 6 could be arranged to include the possibility of issuing an acoustic warning, loud enough to wake a sleeping driver in a quick and efficient way. Another possible embodiment of the invention may include artificial generation of sound and vibrations in the vehicle, similar to those which occur when the vehicle runs over road rumble strips and with enough amplitude to wake-up the driver. Such additional warning systems are for simplicity not shown in FIG. 1-3, but are included in the invention.

Should no response in the form of steering wheel activity be registered by the steering wheel angle sensor 51 within a short, prescribed time after start of the wake-up alarm (V) a system according to the invention may be brought to send a distress signal (SOS), which activates other safety systems 13 in the vehicle for further automatic interference to prevent or reduce traffic accident injuries.

Two embodiments of the present invention have been described. It is clear that experts in the field may find alternative embodiments of the invention and various modifications and ways of solving the proposed functionality without departing from the present invention.

The present invention shall therefore not be regarded as limited to the embodiments described above, but can be varied within the scope of the attached patent claims.

The invention claimed is:

1. A method of waking up a sleeping vehicle driver with a wake-up alarm, the release of which is controlled by threshold values from at least two different detection systems, the method comprising:

detecting, by a first one of the detection systems, driver inactivity;

detecting, by at least another one of the detection systems, the movement of a vehicle relative to one or more of a lane in which the vehicle is driving and objects near the vehicle;

generating an alarm generated by a device that generates vibrations in a steering wheel of the vehicle when one of a first requirement and a second requirement is fulfilled and separately generating the alarm when the other of the first requirement and the second requirement is fulfilled, the first requirement being that a predetermined first shorter period of time for driver inactivity passes and a predetermined threshold value for the vehicle movement is reached, a second requirement being that only a predetermined longer period of time, which is longer than said shorter period of time, for driver inactivity passes.

2. The method according to claim 1, wherein said other detection system for the vehicle movement includes at least a second detection system configured to detect a lateral departure of the vehicle from the driving lane, a third detection system configured to detect relative speed and a distance to an object in the travelling direction of the vehicle, and a fourth detection system configured to detect relative speed and a distance to objects that are present perpendicularly to the travelling direction of the vehicle, wherein the wake-up alarm is be released when the first detection system detects that said predetermined first shorter period of time for driver inactivity is crossed and at least any of the third detection system and the fourth detection system exceed a predetermined threshold value for the respective detection system.

3. The method according to claim 2, further comprising inhibiting the alarm when the first detection system does not detect that the predetermined longer period of time for driver inactivity passes, and none of said second, third and fourth detection systems reaches its respective threshold value.

4. The method according to claim 1, wherein said shorter period of time is less than seconds and said predetermined threshold value exceeds 4 seconds.

5. The method according to claim 1, further comprising generating the alarm by a device configured to imitate sound and/or vibrations that occur at passage of the vehicle over road rumble strips and with sufficient amplitude to wake up the driver.

6. The method according to claim 2, wherein said shorter period of time is less than 2 seconds and said predetermined threshold value for each of the detection systems exceeds 4 seconds.

7. The method according to claim 3, wherein said shorter period of time is less than 2 seconds and said predetermined threshold value for each of the detection systems exceeds 4 seconds.

8. The method according to claim 2, further comprising generating the alarm by a device configured to imitate sound and/or vibrations that occur at passage of the vehicle over road rumble strips and with sufficient amplitude to wake up the driver.

9. The method according to claim 3, further comprising generating the alarm by a device configured to imitate sound and/or vibrations that occur at passage of the vehicle over road rumble strips and with sufficient amplitude to wake up the driver.

10. The method according to claim 4, further comprising generating the alarm by a device configured to imitate sound and/or vibrations that occur at passage of the vehicle over road rumble strips and with sufficient amplitude to wake up the driver.

11. The method according to claim 6, further comprising generating the alarm by a device configured to imitate sound and/or vibrations that occur at passage of the vehicle over road rumble strips and with sufficient amplitude to wake up the driver.

12. The method according to claim 7, further comprising generating the alarm by a device configured to imitate sound and/or vibrations that occur at passage of the vehicle over road rumble strips and with sufficient amplitude to wake up the driver.

* * * * *